United States Patent [19]

Oh

[11] Patent Number: 4,635,023

[45] Date of Patent: Jan. 6, 1987

[54] FUSE ASSEMBLY HAVING A NON-SAGGING SUSPENDED FUSE LINK

[75] Inventor: Seibang Oh, Elk Grove Village, Ill.

[73] Assignee: Littelfuse, Inc., Des Plaines, Ill.

[21] Appl. No.: 736,181

[22] Filed: May 22, 1985

[51] Int. Cl.[4] ..... H01H 85/04

[52] U.S. Cl. ..... 337/163; 337/166; 337/295

[58] Field of Search ..... 337/163, 164, 165, 166, 337/160, 264, 255, 198, 295, 296, 297

[56] References Cited

U.S. PATENT DOCUMENTS

| | | | |
|---|---|---|---|
| 2,055,866 | 9/1936 | Jung et al. | 337/295 |
| 2,502,747 | 4/1950 | Popp | 337/163 |
| 3,140,371 | 7/1964 | Johann et al. | 337/295 |
| 4,349,804 | 9/1982 | Gaia | 337/198 |

*Primary Examiner*—Harold Broome

*Attorney, Agent, or Firm*—Russell E. Hattis

[57] ABSTRACT

A fuse assembly has a fuse link extending suspended in a housing between a pair of terminal extensions, which the fuse link interconnects electrically. A fuse blowing current-reducing material like tin is carried on the fuse link and spaced from and on opposite sides of the hot spot of the fuse link where the fuse is expected to blow.

15 Claims, 6 Drawing Figures

FUSE ASSEMBLY HAVING A NON-SAGGING SUSPENDED FUSE LINK

DESCRIPTION

Cross-Reference To Related Application

This application is related to another application filed herewith titled "Plug-In Fuse Assembly With Stackable Housing" and whose inventor is John M. Borzoni. The present application and the cross-referenced application are commonly assigned to the same owner.

TECHNICAL FIELD OF THE INVENTION

This invention relates to fuses usually having a high current rating such as above 30 amps, and where the fuse links are relatively long and are unsupported between the ends thereof to create a sagging problem.

While the invention has its most important application in blade-type automobile fuse, it is applicable to cylindrical and other types of fuses.

BACKGROUND OF THE INVNETION

Automobile blade type plug-in fuse assemblies commonly comprise a two-piece assembly heretofore having a thin, box-like housing and a planar, plate-like, all metal plug-in fuse element secured therein. The metal plug-in fuse element has a pair of spaced, confronting, exposed terminal blades extending from one end of the housing. Current-carrying extensions of the terminal blades extend into the housing where they are closely encompassed by the housing walls. A fuse link unsupported between the ends thereof extends suspended between the current-carrying extensions and is spaced from the housing side walls which are closely spaced from the fuse link in comparison to, for example, the spacing of the housing walls from a fuse link of conventional threaded type fuses used in homes.

The housing has slot-like spaces opening to one end of the housing, the terminal blades project from these spaces where they can be plugged into socket clips in a mounting panel or fuse block. This structure and method of making the same are described in other patents including U.S. Pat. Nos. 3,909,767 and 4,344,060. Fuse blocks in presently made automobiles generally provide a vertical mounting wall designed so that when the fuse is mounted thereon the terminal blades extend horizontally in a horizontal plane from the housing and gravity acts on the fuse link in a direction where any significant sagging thereof can cause the fuse link to touch the housing side wall spaced a short distance below it and cause problems to be described.

The fuse link of this and other types of fuse assemblies melts and sometimes vaporizes under fuse blowing conditions. Fuses generally are designed to blow under both prolonged modest overload current (like 135% of rated current within ½ hour) or instantly under short circuit current. Under such a prolonged modest overload current the temperature of the fuse link progressively rises until the fuse blows. The temperature rise in the fuse link results from electrical power dissipation in the electrical resistance R of the fuse link material due to electrical current I flow therethrough. The formula describing this power dissipation P is $P=I^2R$.

Under normal operation (normal current is usually about 80 percent of rated current), the heat dissipated in the fuse link is sufficiently small that a large section of the fuse link does not melt or even soften. Heat generated in the fuse link is conducted into the terminal blade portions, housing and panel socket clips. When a current substantially above rated current (like 135% thereof) flows in the link, the heat dissipation is such that there is an insufficient rate of conduction of heat therefrom so that the temperature rises to the blowing temperature. The fuse link will soften before it melts, and it is important to the reliability of the fuse that before blowing the fuse link does not soften to a degree that a large section of the fuse link sags against a side wall of the housing before the desired fuse blowing conditions occur. If this occurs, the contact made between a sagging fuse link and the housing can melt the fuse housing and cool the fuse link and prevent it from blowing in the desired time period or from blowing at all. Such contact, in any event, modifies the blowing characteristics of the fuse link. The automobile blade fuses have heretofore been made only for current ratings up to 30 amperes. The fuse links of these fuses are so short and thin that they do not generally sag enough to cause any problems. However, such fuses are now being designed for currents well above 30 amperes and their fuse links are so long and thick that, prior to the present invention, a serious sagging problem was encountered if not supported.

A fuse link of even cross-sectional areas throughout will generally have the hottest spot at the center thereof. In such case, the temperature verses fuse link position curve progressively increases toward the center point thereof. In designing a fuse for a given blowing delay time, if it is necessary to increase the delay from an initial test value, the volume of the fuse is increased by increasing the length and/or cross sectional area thereof. The latter decreases the overall fuse link resistance while the former increases its resistance. The increase in fuse length also increases the tendency of the fuse link to sag.

Sometimes the desired fuse parameters are achieved by providing a central fuse link of suddenly reduced cross section which provides a temperature verses fuse link position curve which sharply rises at the center of the fuse link. In either case the fuse link will usually initially blow at this center point.

The sagging problem described does not occur if the fuse housing is filled with a material like sand, which is used in some fuses to quench high energy arcs. The use of sand, however, purely as a support for a fuse link is not practical in fuses where arc quenching can be achieved in a more economical way. Thus, the packing of sand or other support materials into the fuse assembly housing requires an additional assembly steps and material that add to the cost of the final product and is therefore undesirable.

The blowing current of the fuse link is a function of many factors including the resistance of the fuse link and the metal alloy out of which it is made, as well as the configuration thereof. It is known that the blowing current or blowing temperature of a fuse link can be reduced by applying a material such as tin to a fuse link or other fuse configuration, like a spiral winding of fuse wire on a core of insulating material. Thus, in prior art fuses tin has been applied in the form of beads on the successive windings of a spiral wound fuse wire to reduce the blowing current or blowing temperature of the fuse wire. In a fuse link used in a conventional threaded type fuse used in homes, tin has been applied for this purpose in the form of a plug overlay or globule of tin added to the fuse link on only one side of the reduced center portion of the fuse link involved. The tin migrates at a rate which is a direct function of the temperature of the point on the fuse link toward which the tin can migrate. In the threaded fuse described, the tin migrates at the highest rate toward the hottest center portion of the fuse link. The tin alloys with the fuse metal and reduces the blowing current.

SUMMARY OF THE INVENTION

I have unexpectedly discovered that tin or other blowing current-reducing material selectively applied to only certain portions of a fuse link alters the temperature verses fuse link position curve thereof in the region where the tin is placed and migrates to a significant degree. If the quantity of tin noted above is placed only in the central region of the fuse link and on opposite sides of the "hot spot" present in this region, the tendence of the fuse link to soften and sag before the fuse link blows is greatly reduced if not eliminated. If the quantity of tin noted above is placed on only one side of the "hot spot" of the fuse link, the sagging problem described is not satisfactorily alleviated because the fuse link on the side where the tin is not placed is not affected much by the tin on the other side thereof. Thus, it is a main feature of the invention to place areas of tin on limited areas of both sides of and spaced from the "hot spot" of a fuse link for the purpose of primarily materially decreasing the tendency of the fuse link to soften and sag before the blowing conditions occur. The desired blowing current is obtained by proper selection of the various parameters (in addition to the amount and location of the tin) which effects this current.

The anti-sag quality of a blowing current-reducing material selectively applied to a suspended fuse link as described is believed to be previously unknown.

While this invention is applicable to all types of fuses having a meltable fuse structure suspended between and interconnecting a pair of opposed terminals, it finds particular utility in an enclosed automobile blade-type fuse as described where the housing side walls are fairly close to but yet spaced from the fuse link by a sufficient distance not to significantly affect the blowing current of the fuse.

Thus, in the preferred embodiment of the invention, the enclosed plug-in fuse assembly has a thin housing and coplanar stamped plug-in fuse metal element as previously described. The fuse link is shaped to provide a maximum length to maximize time delay, and a suddenly reduced cross-section is preferably formed centrally on the fuse link. The fuse link portion of the plug-in metal element preferably has a width in the plane of the element which is many times its thickness, because such a configuration has the least tendency to sag when gravity is operating in a direction parallel to the thickness of the fuse link which is the case where, as previously indicated, the fuse is supported in a vertical fuse block with the terminal blades extending horizontally and in a horizontal plane.

Tin or other fuse blowing current-reducing material is applied to the fuse link spaced on opposite sides of the location of the fuse link at which the hot spot and initial fuse melting are expected to occur, in this case, at the centrally located suddenly reduced cross section. The tin material is preferably in the form of plugs inserted into openings in the fuse link equi-distant from the center of the fuse link, with the plugs being fastened in the openings by compressing the plug material so that its ends form lips that overlap both sides of the fuse link material. Less desirably, the tin could be applied as a localized layer on the fuse link. When a plug of tin was placed immediately next to the hot spot on one or both sides thereof, the fuse link still sagged. It was thus concluded that the tin plug or layer should be placed in substantially spaced relation to the hot spot on both sides of the hot spot and at a point spaced therefrom as determined by a trial and error method. It is believed that the fuse blowing current reducing plugs of a tin or similar material when properly placed in the portion of the fuse link where sagging heretofore occurred unexpectedly substantially reduced the amount of sagging.

Other features and advantages of the invention will become apparent upon making reference to the description to follow, the drawings, and the claims.

DESCRIPTION OF THE PREFERRED EMBODIMENT

It would be helpful better to understand the invention first to give a brief discussion of the problem encountered in a fuse assembly to which the present invention has not been applied. As previously indicated, the present invention evolved out of an effort to modify the blade-type automobile fuse assembly shown in said U.S. patents which were designed for rated currents up to 30 amperes. When these fuses were designed for automobile circuits well in excess of 30 amperes, both the fuse links and housings had to be greatly increased in size. To obtain the necessary blowing and time delays the length of the fuse link found necessary caused the element sagging and housing melting problem previously described.

Figure 1:
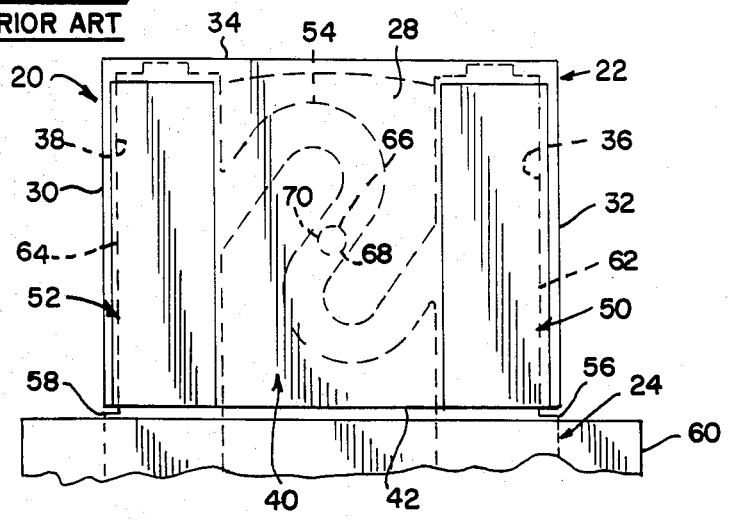
FIG. 1 PRIOR ART
FIG. 1 is a bottom view of a plug-in fuse assembly which does not incorporate the present invention inserted with a horizontal orientation into a socket of a fuse mounting block with a vertical mounting surface.
Figure 2:
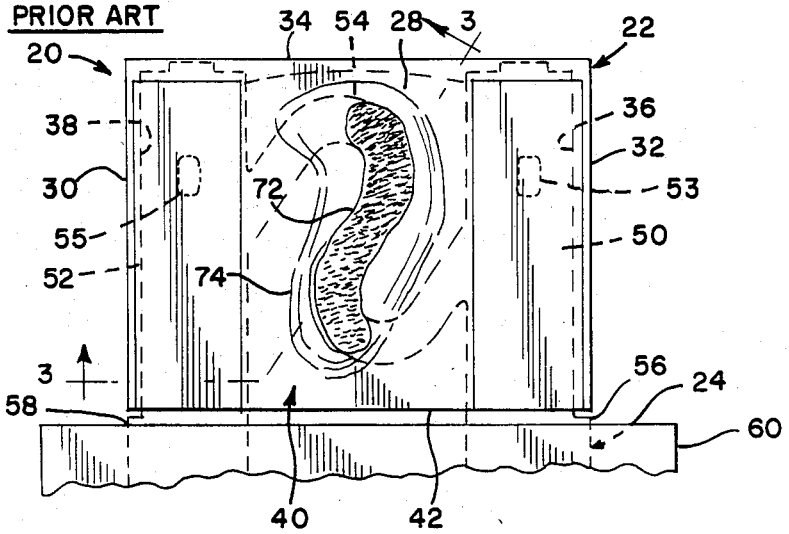
FIG. 2 PRIOR ART
FIG. 2 is the same bottom view of the fuse assembly of FIG. 1 after the suspended fuse link has failed properly to operate by sagging and charring the assembly housing.
Figure 3:
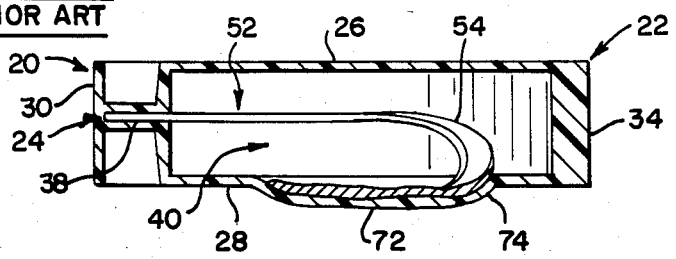
FIG. 3 PRIOR ART
FIG. 3 is a sectional view taken along the line 3—3 of FIG. 2 and in the direction indicated by the arrows.

In FIGS. 1, 2, and 3, there is shown a prototype design 20 which had such a sagging problem. As in the case of the prior much smaller blade type fuses, it had only two component parts, a housing 22 and fuse element 24. The housing 22, which is of a modified shape than that used before, is most advantageously molded from synthetic plastic material into a unitary part defining a series of interconnecting cavities for receiving the different sections of the fuse element 24 therein. The fuse element 24 is most advantageously stamped from a strip of fuse metal, such as zinc, to form a generally planar and unitary piece part having sections that are inserted into the housing cavities. The fuse element 24 is secured in housing 22 by any suitable means desired and preferably by cold staking and ultrasonic welding operations.

Housing 22 uniquely has a generally rectangular configuration which when oriented vertically has a flat top wall 34 relatively closely spaced side walls 26 and 28, and interconnecting narrow end walls 30 and 32. These walls define an interior hollow forming a pair of narrow passageways 36 and 38 on opposite sides of the housing which closely receive terminal blade extensions 50 and 52 and a relatively wide central fuse link-receiving chamber 40 where the housing walls are spaced from the fuse link 54 a distance where sagging of the fuse link will not cause undesired contact between the fuse link and housing when gravity acts in the direction of the thickness of the fuse link to be described. The passageways 36 and 38 and chamber 40 open to one end 42 of the housing from which terminal blades 56 and 58 of the fuse element extend. The housing preferably is transparent to provide clear viewing of the fuse element in the chamber 40 for determining if the fuse element is intact, or "blown".

A fuse link 54 extends transversely between the terminal blade extensions 50 and 52 and terminal blades 56 and 58 extend therefrom in spaced, confronting, parallel relationship from the open end 42 of the housing. The terminal blades 56 and 58 can be plugged into a panel mounted socket 60 to connect the fuse element 24 in series with a desired circuit. The panel involved generally is arranged vertical so that when the fuse is plugged into the panel the terminal blades are in a common horizontal plane.

The terminal blade extensions 50 and 52 located respectively in passageways 36 and 38 are initially frictionally engaged within the passageways and final securing of the extensions in the passageways is achieved by cold staking or ultrasonic welding of the housing side walls 26 and 28 into apertures in these extensions at 53 and 55. The fuse link 54 has a length, width and thickness dimensioned relative to the resistance of its fuse metal material to set its current fusing qualities. In the high current fuse shown, the fuse link 54 has long and relatively wide dimensions to carry relatively high currents for relatively long periods before blowing. The length of fuse link 54, which is much greater than the distance between the extensions 50 and 52, is accommodated by its sinuous or "S" shape.

Fuse link 54 has an aperture 66 therein for fixing the location of the hot spot at which the fuse link is intended to blow. The fuse link material removed by formation of aperture 66 leaves opposed, lateral hot spotforming walls 68 and 70 that exhibit increased electrical resistance and that are to melt under prolonged modest overload current to separate the fuse link into two spaced apart arms cantilevered from their respective extensions 50 and 52.

The problem, illustrated in FIGS. 2 and 3, that occurs in such a fuse assembly and with which the invention is concerned is that current flowing through the fuse link in certain high current or overcurrent situtions causes the fuse link material to soften at a temperature, much lower than its melting temperature, along a major central portion of its length before melting at the hot spot walls 68 and 70. Gravity then causes sagging of the fuse link 54 to an extent that the central portion including the hot spot aperture 66 of the fuse link contacts a portion 72 of the then bottom side wall 28. The wall 28 then acts as a heat sink wherein the fuse will not blow at its designed overload current condition. The heat absorbed by the housing walls contacted by the sagging fuse link also causes charring of the wall and softens and deforms the surrounding portions of the wall 74.

The result of this condition is a dangerous malfunction of the fuse assembly. High and possibly dangerous overcurrent remains flowing through the fuse assembly and its related circuit while the fuse link rests on the bottom wall, possibly causing destruction of expensive components in the related circuit in which it is connected. Fire caused by overheating circuit elements is possible. In any event, malfunction of the fuse assembly is intolerable.

Figure 5:
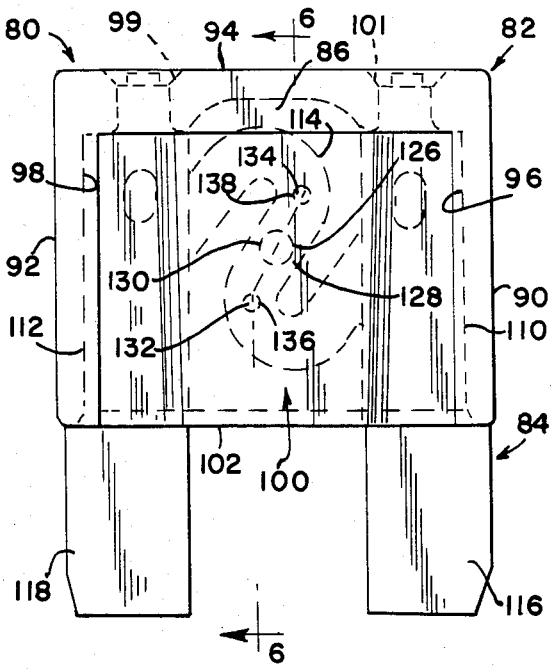
FIG. 5 a plan view of the plug-in fuse assembly including the invention.
Figure 4:
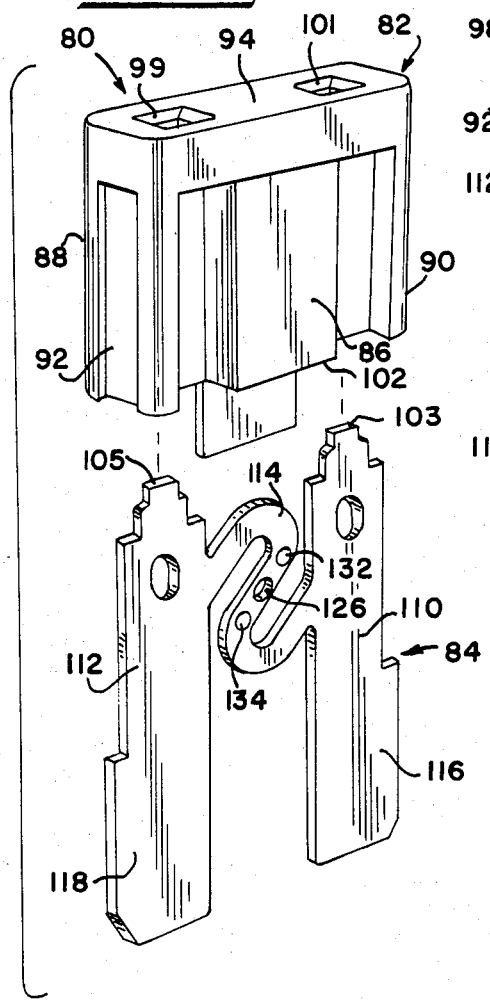
FIG. 4 is an exploded perspective view of a plug-in fuse assembly including the invention.
Figure 6:
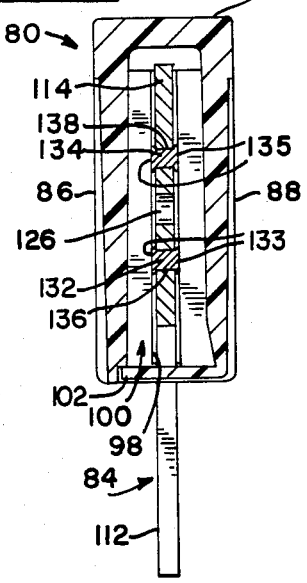
FIG. 6 is a sectional view taken along the line 6—6 of FIG. 5 and in the direction indicated by the arrows.

The solution to this problem involves the application of a fuse blowing current-reducing material in a manner totally different from its previous manner of use. Turning now to the preferred embodiment of the invention shown in FIGS. 4, 5 and 6, the plug-in fuse assembly 80 there shown is similar to the previously described fuse assembly 20 and comprises a housing 82 and a fuse element 84.

Housing 82 has a generally rectangular configuration defined by relatively closely spaced main side walls 86 and 88, interconnecting end walls 90 and 92 and a top outer wall 94. These walls define interior cavities such as a pair of narrow blade extension-receiving passageways 96 and 98 and a central chamber 100. The passageways and chamber open to one end 102 of the housing and extend substantially into the entire depth of the housing. The passageways 96 and 98 open onto the outer wall 94 at 99 and 101 to expose probe-receiving tabs 103 and 105 forming part of the fuse element 84. The material of the housing preferably is the same as for housing 22 to provide the same viewing feature. Further details of the housing are included in said related patent application filed herewith entitled "Plug-In Fuse Assembly With Stackable Housing".

Fuse element 84 has a pair of opposed, flat and rectangular terminal blade extensions 110 and 112, which terminate in the tabs 103 and 105, and a central fuse link 114, extending therebetween. The terminal blade extensions 110 and 112 form terminal blades 116 and 118 that extend in spaced, confronting, parallel relationship from the open end 102 of the housing. The terminal blades 116 and 118 can be plugged into a panel mounted socket in a manner similar to that of fuse assembly 20. The fuse element 84 is mounted in the housing 82 in the same manner as fuse element 24 is mounted in the housing 22 in FIGS. 1–3.

Fuse link 114 includes an aperture 126 therein for fixing the location of the hot spot at which the fuse link is intended to blow. The aperture forms opposed, lateral hot spot-forming walls 128 and 130 of smaller overall cross-section than the rest of the fuse link that melt to separate the fuse link into two spaced apart arms cantilevered from the terminal blade extensions 110 and 112. In a preferred embodiment in which the fuse is rated at 55 amperes, the fuse link 114 has a width of approximately 0.147 inch (0.37 cm), a thickness of approximately 0.032 inch (0.08 cm), and the aperture 126 has a diameter of approximately 0.080 inch (0.20 cm). The fuse link can be thinner than the rest of the plug-in fuse element.

Fuse link 114 additionally includes a pair of apertures 136 and 138 located in the central third of the fuse link, and preferably spaced from the hot spot-producing aperture 126 by an equal distance slightly less than one third the length of each half of the fuse link shown. The apertures 136 and 138 have diameters of 0.06 inch and their centers are spaced 0.15 inches from the center of aperture 126. Plugs 132 and 134 of blowing current-reducing material fill the apertures or openings 136 and 138 and have a lower melting temperature than that of the fuse link fuse material. The plugs of tin used in the exemplary form of the invention are 100% tin with a rosin flux core. The plugs and openings are also centered substantially on the longitudinal center line of the fuse link. Plugs 132 and 134 are secured in openings 136 and 138 by compressing the ends of the plugs to form heads 133 and 135 that overlap the material of fuse link 114, effectively riveting the plugs in the openings. Other methods of securement are possible.

Individual plugs of tin material previously were used in fuse links on only one side of a fuse link hot spot to reduce the current at which the fuse would blow. As previously indicated the fuse links involved has no substantial sagging problem.

In experimental work leading up to the present invention, only one such plug was applied to fuse link 114 on one side of aperture 126. When the fuse was inserted into a circuit carrying a modest overload current, the fuse link sagged. When plugs of tin material were uniquely applied to the fuse link 114 on both sides of aperture 126 as described, neither side sagged. The operability of the invention is believed due to the unexpected result that the tin modified the temperature verses fuse link location profile curve so that the temperature of the fuse link in the vicinity where the tin is located is substantially lowered so that the zinc fuse material does not soften as much. However, the tin still has the effect of lowering the current needed to blow the fuse at the hot spot of the fuse link.

Even though these plugs are described for use in a plug-in blade-type fuse assembly, it is believed that this invention will find utility whenever a fuse link is suspended free between its ends and the fuse link is of a length to cause a sagging problem. Further, it is believed that the invention is also operable, although not as effectively, where the tin is applied as coatings or beads on the surface of the fuse link rather than as plugs of tin within apertures in the fuse link. Lastly, materials other than tin that have the same blowing current-reducing qualities can be used for the plugs, coatings or beads referred to within the scope of the invention.

Thus, while the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. In a fuse assembly for interrupting a current flowing therethrough upon certain high current conditions, said assembly including: a housing made of electrically insulating material and having a space therein;

a conductive fuse-forming element secured in said housing including a pair of terminals that are adapted to be connected into a circuit; and a fuse link connected between said terminals and suspended in said space without support between end portions thereof so that it can sag against the housing walls when softened below the blowing temperature, and said link having a hot spot portion along its length at which said link is expected to blow under said high current conditions as a result of high temperature effected melting caused by said high current condition in said link, the improvement wherein said link includes fuse blowing current-reducing material spaced from and on opposite sides of said hot spot portion of the fuse link in the region of the fuse where sagging is expected, the spacing of said material being such as to inhibit the softening and sagging tendency of the unsupported portions of the fuse link prior to the desired blowing thereof

2. In a plug-in fuse assembly for interrupting a current flowing therethrough upon certain high current conditions, said assembly including:

a housing made of electrically insulating material and having an inner space open to one side thereof and having relatively closely spaced side walls defining cavities forming a fuse link-receiving chamber and relatively narrow passages on opposite sides of said chamber; and a conductive plug-in fuse-forming element having a pair of confronting, spaced terminal blade portions respectively projecting from said housing through said open side, a pair of extensions of said terminal blade portions in said passages and a fuse link in said chamber suspended in said chamber between said extensions and spaced from said side walls to electrically interconnect the pair of extensions and their related projecting terminal blade portions, said link being adapted to carry said current flow from one terminal blade portion and its related extension to the other terminal blade portion and its related extension, and said link having a hot spot portion along its length at which said fuse link is expected to blow under certain high current conditions as a result of high temperature effected melting of the fuse link material caused by said certain high current conditions in said fuse link, wherein the improvement comprises said fuse link including fuse blowing current-reducing material spaced from and on opposite sides of said hot spot portion of the fuse link in the region of the fuse where sagging is expected, the spacing of said material being such as to inhibit the softening and sagging tendency of the unsupported portions of the fuse link prior to the desired blowing thereof.

3. A fuse link to be suspended between a spaced apart pair of extensions of terminals that are to be connected in a current carrying circuit to electrically interconnect said terminals and extensions and said fuse link further being adapted to be suspended in a chamber of a housing that is made of electrically insulating material with the fuse link spaced from walls of said housing, said fuse link comprising:

a link of fuse metal having a hot spot portion along its length at which said link is expected to blow under certain high temperature conditions as a result of high current conditions flowing through said link, and fuse blowing current-reducing material on said link and spaced from and on opposite sides of the hot spot portion of said link, the spacing of said material being such as to inhibit the softening and sagging tendency of the unsupported portions of the fuse link prior to the desired blowing thereof.

4. The fuse assembly or fuse link of claim 1, 2 or 3 in which said fuse blowing current-reducing material is equally spaced on opposite sides of said hot-spot portion.

5. The fuse assembly or fuse link of claim 1, 2 or 3 in which said link has a pair of openings therein on opposite sides of said hot spot portion and said fuse blowing current-reducing material is in the form of a pair of plugs installed in said openings.

6. The fuse assembly or fuse link of claim in which said plugs have heads overlapping said link to fasten the plugs in the openings.

7. The fuse link of claim 3 in which said link has a length greater than the distance between the ends thereof.

8. The fuse assembly or fuse link of claim 4 in which said link is relatively wide and has an aperture formed therein at said hot spot portion suddenly to reduce the cross section of the link thereat.

9. The fuse link of claim 3 in which said link is "S" shaped and in a plane parallel to said housing side walls.

10. The fuse assembly or fuse link of claim 1, 2, or 3 in which said fuse blowing current-reducing material is tin and the fuse link material is a zinc alloy.

11. The fuse link of claim 3 wherein said hot spot portion is in the center of said fuse link and said fuse blowing current-reducing material is located only in the central portions of said fuse link.

12. The fuse assembly or fuse link of claim 1, 2 or 3 wherein at least said fuse link is planar and has a width in its plane that is many times its thickness.

13. The fuse assembly of claim 1, 2 or 3 wherein said link has a non-circular cross section wherein the longest dimension thereof is many times the thickness thereof, and further wherein the fuse is to be ultimately mounted with an orientation where gravity acts in the direction of the thin dimension thereof.

14. The fuse assembly of claim 2 wherein said plug-in fuse element is a thin planar plate-like body, and said fuse link has a non-circular cross section where the width thereof is many times the shortest dimension or thickness thereof and said longest dimension thereof is in a plane parallel of said element.

15. The fuse assembly or fuse link of claim 1, 2 or 3 wherein said fuse blowing current-reducing material is substantially within the central one third of the fuse link.

* * * * *